US005289985A

United States Patent [19]

Cocchi et al.

[11] Patent Number: 5,289,985

[45] Date of Patent: Mar. 1, 1994

[54] DEVICE FOR CHANGING REELS OF STRIP MATERIAL ON A PRODUCTION MACHINE

[75] Inventors: Lorenzo Cocchi; Antonio Gamberini, both of Bologna, Italy

[73] Assignee: G.D. Societa' Per Azioni, Bologna, Italy

[21] Appl. No.: 957,807

[22] Filed: Oct. 8, 1992

[30] Foreign Application Priority Data

Oct. 10, 1991 [IT] Italy ..... BO91 A 000362

[51] Int. Cl.[5] ..... B65H 19/12

[52] U.S. Cl. ..... 242/58.6

[58] Field of Search ..... 242/58-58.6, 242/79

[56] References Cited

U.S. PATENT DOCUMENTS

| | | | |
|---|---|---|---|
| 4,564,150 | 1/1986 | Keene et al. | 242/58.1 |
| 4,840,321 | 6/1989 | Focke et al. | 242/58.6 |
| 5,031,381 | 7/1991 | Focke | 242/58.6 |
| 5,135,103 | 8/1992 | Focke et al. | 242/58.6 |
| 5,205,505 | 4/1993 | Focke et al. | 242/58.6 |
| 5,219,127 | 6/1993 | Boldrini et al. | 242/58.6 X |

*Primary Examiner*—John M. Jillions

*Attorney, Agent, or Firm*—Sandler Greenblum & Bernstein

[57] ABSTRACT

A device for changing reels of strip material on a production machine, whereby a traction device unwinds a first strip off a runout reel on a supporting spindle and feeds it to the production machine along a given path; a standby reel is supported on edge on a saddle defined by two rollers; and a swing arm supports a powered disk with suction cups and a locating spindle. As the first strip runs out, the standby reel is made integral with the disk by the suction cups; the disk is accelerated so as to wind a second strip, identical to the first, off the standby reel and through a guide device by which the second strip is inserted into the traction device; and the swing arm loads the standby reel on to the axially-sliding supporting spindle in place of the empty reel.

7 Claims, 4 Drawing Sheets

D
24
25
20
47
22
23
13
30
46
B
40
23a
C
35
45
41
46
36
37
38
13
39
9
43
13
44

13
26
23

8
8
27
7
23a
22
A
D
33
24
30
C
33
31
32
25
34
28
9
20
34
21
B
47'
27
29

DEVICE FOR CHANGING REELS OF STRIP MATERIAL ON A PRODUCTION MACHINE

BACKGROUND OF THE INVENTION

The present invention relates to a device for changing reels of strip material on a production machine.

The present invention is especially suitable for use on packing machines, particularly cigarette packing machines, to which the following description refers purely by way of example.

For special purposes, such as inner wrappings, cigarette packing machines employ a strip of foil fed off a reel and subsequently cut into portions from which the inner wrappings are formed. As it is about to run out, the reel is changed as described, for example, in Italian Patent Application N. 3473A/90, the content of which is included herein as required by way of reference.

According to the above method, a strip feed device is provided whereby the runout reel, supported on a spindle, is wound off by a traction device by which it is guided along a path comprising a first and second branch forming a given angle of other than 180°; and a second identical strip is wound off a standby reel along the first branch of said path by means of a centerless unwinding device on which the standby reel is arranged on edge. As the first strip is about to run out, the unwinding device rotates the standby reel so as to accelerate the second strip up to the speed of the first; the first strip is cut upstream from the traction device; the second strip is cut along the first branch and fed on to the traction device; and the tail end of the first strip is discarded.

At this point, a transfer device provides for removing the empty reel and replacing it with the standby reel being unwound, e.g. by means of a swing arm with a spindle for unloading the standby reel off the centerless unwinding device, which may thus be loaded with a new standby reel.

The above system presents several drawbacks, foremost of which is the difficulty encountered in picking up the standby reel as it is being unwound, due to possible misalignment of the swing arm spindle and the reel. Secondly, to pick up the standby reel, the swing arm spindle must be fitted through practically the whole length of the core on the reel, so that it is substantially impossible to guide the standby reel on to the unwinding spindle, the function of which must therefore be performed by the swing arm spindle of the transfer device itself. As a result, the transfer arm is not freed until the reel runs out, thus complicating the design of the transfer device. Lastly, unless the standby reel is wound tightly, the turns in the strip may slip when accelerated up to the speed of the runout reel, thus resulting in "bags" forming in the strip and, particularly in the case of narrow reels, in oscillation of the reel in turn resulting in fallout and tearing of the strip, etc.

SUMMARY OF THE INVENTION

It is an object of the present invention to provide a reel change device designed to overcome the aforementioned drawbacks.

More specifically, it is an object of the present invention to provide a device for changing reels of strip material on a production machine, which is relatively straightforward in design, enables the reel to be changed with absolutely no damage to the strip fed on to the machine, and which provides for guiding and supporting the standby reel at all times.

According to the present invention, there is provided a device for changing reels of strip material on a production machine, said device comprising, in a first operating position, a spindle for supporting a runout reel off which a traction device unwinds and feeds a first strip to the production machine along a given path; means for supporting a standby reel in a second operating position; means for unwinding a second strip, identical to the first strip, off said standby reel and through a guide device located along said given path of said first strip and designed to feed the second strip on to the traction device when the first strip runs out; and a swing arm supporting means for gripping and supporting the standby reel; characterized by the fact that said means for unwinding the standby reel and said means for gripping and supporting the standby reel consist of a powered element fitted to said arm so as to rotate about an axis parallel to the axis of said supporting spindle, and having gripping means for gripping and rendering the standby reel integral with the powered element, and a locating spindle coaxial with the rotation axis of the powered element and so designed as to only cooperate with an input portion of the core of said standby reel; said swing arm being designed to transfer said standby reel from said second operating position on to said spindle supporting the runout reel, when said first strip runs out.

More specifically, according to a preferred embodiment of the invention as described above, said powered element is a disk mounted in idle manner on one end of said arm, and said gripping means are defined by respective peripheral suction cups arranged in a ring on said disk and connected to a vacuum source.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
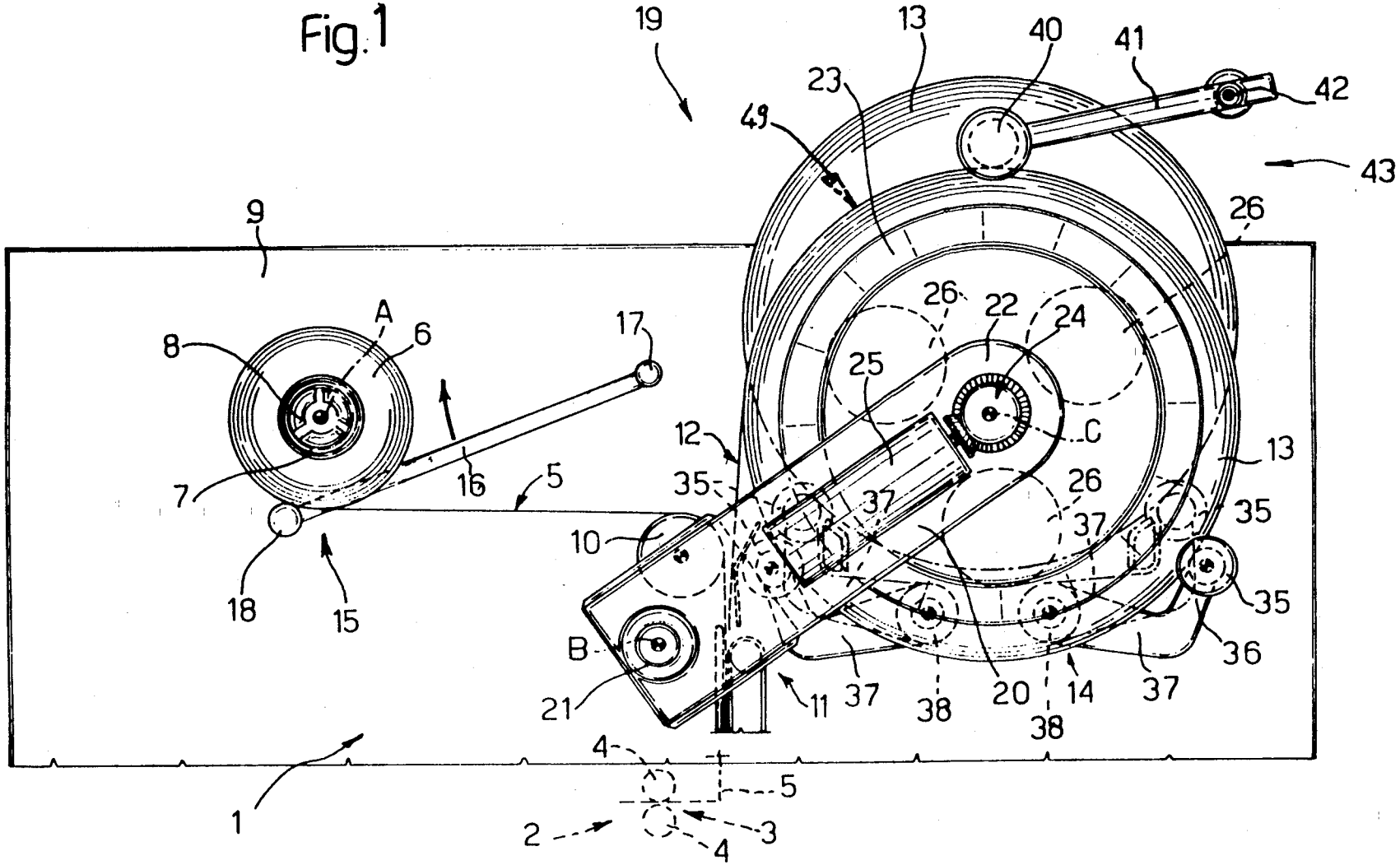
FIG. 1 shows a schematic view of a strip feed device featuring a reel change device in accordance with the present invention.
Figure 2:
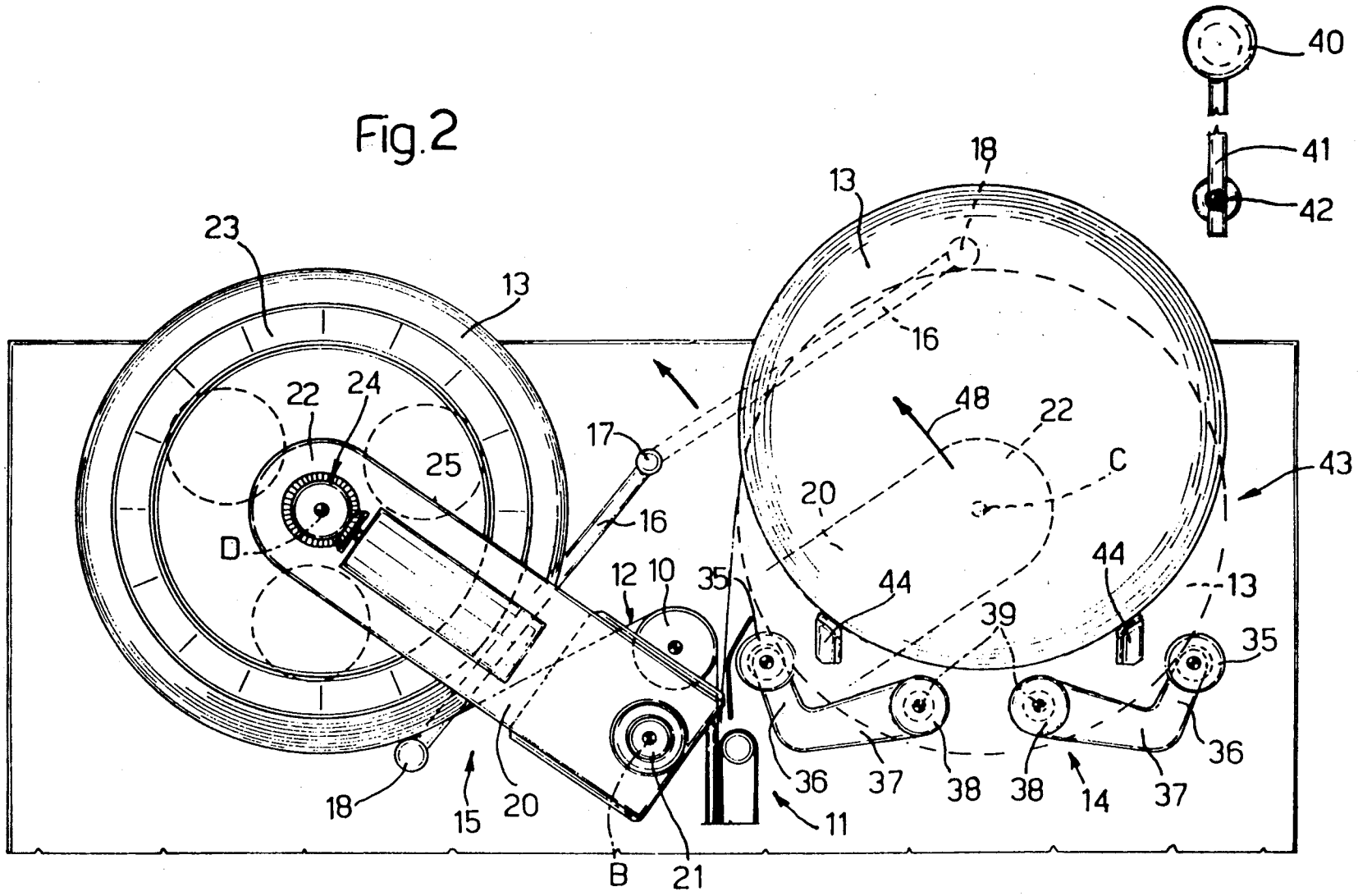
FIG. 2 shows the FIG. 1 devices in a different operating position.

Number 1 in FIGS. 1 and 2 indicates a device for feeding a packing machine 2 (of which only a known traction device 3 defined by two powered embossing rollers 4 is shown by the dotted line) with a strip 5 of foil wound by device 3 off a reel 6 having a core 7 supported for rotation (anticlockwise in FIG. 1) on a spindle 8 in turn supported in idle manner on a base 9. Strip 5 is guided by device 3 and a roller 10 along a given path along which is located a device 11 (shown only partially) for unwinding and guiding a strip 12 identical to strip 5. Strip 12 is wound, as described later on, off a standby reel 13 identical to reel 6 and supported on edge by means consisting of a saddle 14 located to the side of spindle 8 and, like roller 10 and device 11, supported on base 9.

Reel 6, which gradually gets smaller in diameter as strip 5 is fed on to machine 2, is provided with a device 15 for detecting the amount of strip remaining at all times on core 7. Device 15 comprises an arm 16 supported on base 9 so as to rotate about a pivot 17 having its axis parallel to the rotation axis A of spindle 8; and a feel roller 18 held contacting the edge of reel 6 by elastic means (not shown) located between arm 16 and base 9. As arm 16 moves into an angular position in which roller 18 substantially contacts the outer edge of core 7 (indicating runout of strip 5), device 15 activates device 11, as described later on, for rotating reel 13 on saddle 14, accelerating strip 12 up to the same speed as strip 5, and feeding it in place of strip 5 on to traction device 3, as described in co-pending patent application Ser. No. 3473A/90, the content of which is included herein as required in the interest of full disclosure.

Figure 3:
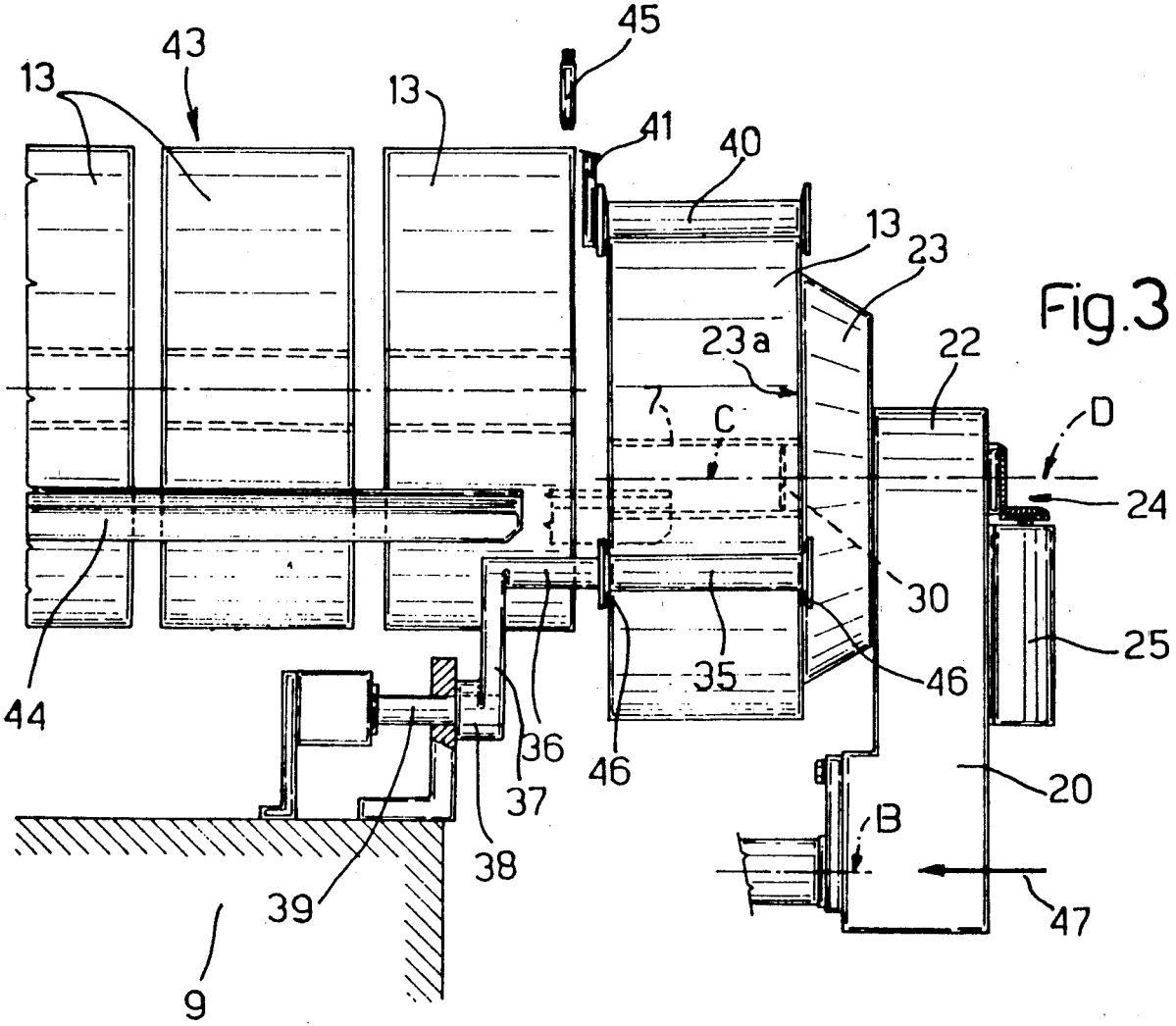
FIG. 3 shows a view, perpendicular to FIGS. 1 and 2, of a detail on the reel change device according to the present invention.
Figure 4:
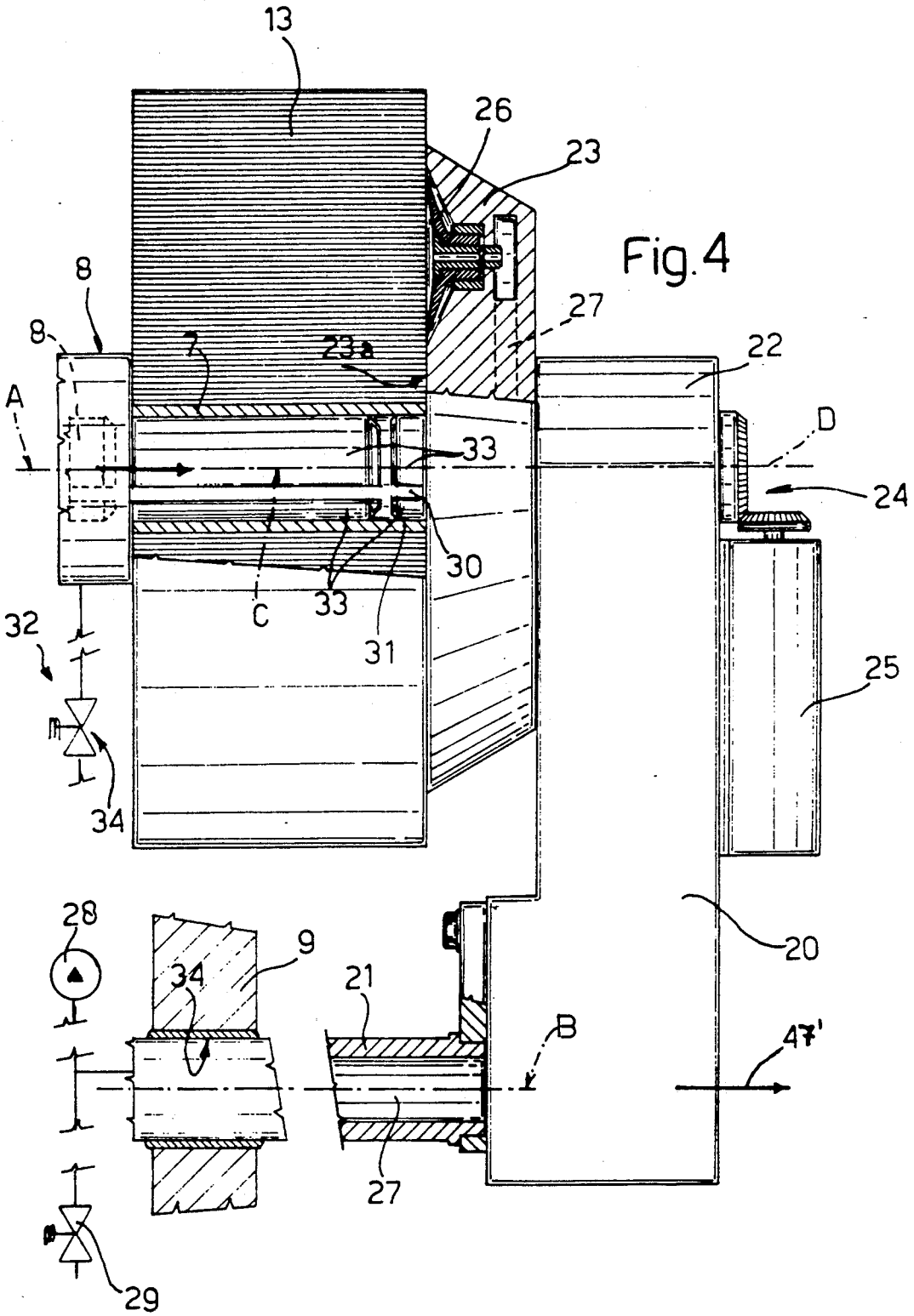
FIG. 4 shows an enlarged partially sectioned view of a detail in FIG. 3 in a different operating position.

Device 1 also comprises a device 19 for replacing reel 6 on spindle 8 with standby reel 13 on saddle 14, once supply of machine 2 has been taken over by standby reel 13 as described above. With reference also to FIGS. 3 and 4, device 19, which is integrated in feed device 1, comprises spindle 8, saddle 14 and a swing arm 20 supported radially on a powered shaft 21 in turn supported on base 9 so as to rotate about an axis B parallel to rotation axis A of spindle 8 and rotation axis C of reel 13. On end 22 opposite shaft 21, arm 20 supports a powered element rotating about an axis D parallel to axes A, B and C, and consisting of n disk 23 powered, via a bevel gear pair 24, by a normally brushless electric motor 25 supported integral with arm 20 and radially in relation to shaft 21.

Disk 23 presents means for gripping and supporting reel 13 and consisting of respective known suction cups 26 equally spaced (in the example shown, three at 120°) about the periphery of disk 23, on surface 23*a* facing saddle 14, and connected, normally by means of a pneumatic circuit 27 formed inside arm 20 and shaft 21, to a vacuum source, e.g. vacuum pump 28 (FIG. 4), and, for the reason explained later, to an optional solenoid valve 29. At and coaxial with axis D, disk 23 also presents an integral locating spindle 30 for reel 13, so designed as to only cooperate with an input portion 31 (FIG. 4) of core 7 of reel 13 (FIGS. 3 and 4) identical to that of reel 6.

Spindles 8 and 30 are designed to simultaneously engage either side of core 7 of reel 13 (FIG. 4). Spindle 8 is self-centering, e.g. a connecting rod type; and spindle 30 may be a self-centering, e.g. cone, type. Spindles 8 and 30 are normally controlled by a known pneumatic system 32 (only part of which is shown in FIG. 4) for moving jaws 33 of spindles 8 and 30 radially in relation to respective rotation axes A and D. More specifically, jaws 33 of spindle 8 are controlled via a solenoid valve 34 for proportionally regulating the control pressure and so enabling gradual, controlled displacement of jaws 33.

Shaft 21 supports arm 20 and disk 23 in a plane parallel to and in front of (as viewed in FIGS. 1 and 2) the planes of reels 6 and 13. By rotating shaft 21 in the appropriate direction, it is therefore possible to selectively and alternatively position arm 20 and disk 23 in a first operating position (FIGS. 2 and 4) wherein spindle 30 is substantially coaxial with spindle 8 supporting runout reel 6, and in a second operating position (FIGS. 1 and 3) wherein spindle 30 is substantially coaxial with rotation axis C of standby reel 13.

Both spindle 8 and disk 23 with spindle 30 are movable axially to and from reels 6 and 13, on either side of the reel plane. More specifically (FIG. 4), spindle 8 is movable selectively into an extracted position, wherein it engages core 7 of reel 6, 13 positioned coaxially in front of it, and a withdrawn position (shown by the dotted line in FIG. 4), wherein it is withdrawn from core 7 of reel 6. Axial displacement of disk 23, on the other hand, is normally effected by moving shaft 21 along axis B and through a seat 34 in base 9, so that, when arm 20 is in said second operating position, disk 23 and suction cups 26 may be brought into contact with reel 13 on saddle 14.

As shown in FIGS. 1 to 3, saddle 14 is defined by a pair of rollers 35, each fitted idly to a first end 36 of a respective lever 37, so as to rotate about a respective axis parallel to axis C. A second end 38, opposite end 36, of each lever 37 is mounted for rotation, parallel to the rotation axis of rollers 35, on a powered pin 39 supported on base 9, so that rollers 35 can be moved between the two positions shown by the continuous and dotted lines in FIG. 1, for adapting saddle 14 to reels 13 of different outside diameters. For ensuring axis C is centered correctly on saddle 14, device 19 also comprises a third roller 40 fitted to one end of a swing arm 41 pivoting about an axis parallel to that of rollers 35. The pivot 42 of arm 41 is so located as to enable arm 41 (powered in known manner not shown) to selectively position roller 40 in an idle position (FIG. 2) wherein it clears standby reel 13 on saddle 14, and an operating position (FIG. 1) wherein it cooperates with reel 13 and is located substantially over saddle 14 and equally spaced in relation to rollers 35.

Device 19 also comprises a store 43 (FIG. 3) for a number of standby reels 13, which are loaded successively on to saddle 14, as described later on. Store 43 comprises a pair of rails 44 parallel to the axis of rollers 35 and to respective powered pins 39 for positioning rollers 35; and means for loading standby reels 13 one at a time on to rollers 35. More specifically, said means comprise means (not shown) for moving rails 44, on which 11 are supported side by side on edge, into the position shown by the dotted line in FIG. 3, wherein the first reel 13, detected by a sensor 45, may be eased on to saddle 14, e.g. by lowering rails 44, via said rail positioning means, towards rollers 35, which present respective shoulders 46 (FIG. 3) for holding and ensuring perfect axial positioning of reel 13 on saddle 14.

In actual use, as runout reel 6 is being unwound, a standby reel 13 from store 43 is loaded, as described above, on to saddle 14 in front of which arm 20 is set to said second operating position. Arm 41 is then lowered into the FIG. 1 position wherein roller 40 contacts the edge of reel 13, thus providing for three-point support of reel 13. In addition, the stop position of roller 40 in relation to the position of rollers 35 indicates the diameter of reel 13, which may be detected in known manner by an appropriate control (not shown) for activating powered pins 39 and so rotating levers 37 for raising/lowering rollers 35 so that axis C is perfectly aligned with axis D (FIG. 3), and reel 13 positioned perfectly coaxial with spindle 30 and disk 23.

At this point, arm 20 is moved in the direction of arrow 47 (FIG. 3) so that surface 23*a* of disk 23 contacts reel 13, and spindle 30 engages portion 31 of core 7 of reel 13, thus aligning reel 13 and disk 23. Suction cups 26 are then activated for rendering reel 13 integral with disk 23, and levers 37 are lowered for detaching rollers 35 from reel 13, while top roller 40 remains contacting reel 13. At this point, motor 25 rotates disk 23 so as to unwind strip 12 off reel 13 and feed it through device 11, and, upon device 15 detecting runout of reel 6, accelerates reel 13 anticlockwise so as to bring strip 12 up to the same speed as strip 5 and effect the changeover on traction device 3 as described previously. In the course of the above stages, roller 40, on the one hand, withstands part of the dynamic load produced by accelerating reel 13, and, on the other, exerts pressure on the edge of reel 13 so as to "strain relieve" and ensure troublefree insertion of strip 12 inside device 11. As the accelerated strip 12 is fed on to traction device 3, motor 25 is turned off and acts as a power brake for tensioning strip 12.

At this point, spindle 8 is withdrawn from core 7 of empty reel 6, which is thus released and removed by an unloading device (not shown); arm 20 is rotated by shaft 21, in the direction of arrow 48, into the first operating position (FIG. 2) so as to wind strip 12 about roller 10 in place of strip 5; spindle 8, which is coaxial with spindle 30 (FIG. 4), is extracted so as to engage core 7 of reel 13; suction cups 26 are deactivated; and arm 20 is moved in the direction of arrow 47' so as to detach spindle 30 and disk 23 from reel 13, which thus takes the place of empty reel 6. Detachment of suction clips 26 and disk 23 from reel 13 may be assisted and effected extremely smoothly by injecting compressed air into circuit 27, by opening solenoid valve 29, so as to rapidly eliminate any remaining vacuum. As soon as reel 13 is released, arm 20 may be restored to the FIG. 1 position, and a farther reel 13 loaded from store 43 on to saddle 14, ready for the next change cycle.

As it is transferred from saddle 14 to spindle 8, reel 13 is accompanied by arm 16, which acts as a locating arm for correctly positioning reel 13 in relation to spindle 8. Pivot 17 in fact is so located as to enable arm 16, upon reel 6 being released, to be rotated by said elastic means into the position shown by the dotted line in FIG. 2, and, as arm 20 is rotated, to be swung back (possibly by means of a motor not shown) with roller 18 maintained contacting reel 13 along the whole of the path described by swing arm 20 during the transfer stage. At the end of the transfer stage, roller 18 and arm 16 are positioned as shown by the continuous line in FIG. 2, wherein roller 18 contacts reel 13 (now the runout reel in place of reel 6) on the opposite side in relation to saddle 14.

As standby reel 13 is accelerated, the present invention therefore provides for eliminating all the drawbacks typically associated with known unwinding devices. In fact, the possibility of any loosely wound turns in the strip slipping and so resulting in "bags" or undesired oscillation is prevented by virtue of the reel being supported laterally over a large number of turns. What is more, during the acceleration stage, the strip no longer contacts the supporting saddle. Finally, any variation in the speed of the strip, particularly during transfer of the reel from saddle 14 to spindle 8, in no way affects the tension of the strip (thus eliminating any danger of the strip being torn) by virtue of the reel being supported solely by suction cups and so being free to slide angularly in relation to disk 23 despite being centered by spindle 30. The small size of spindle 30, which provides solely for centering the reel, also enables supporting spindle 8 to be inserted while reel 13 is still supported on disk 23.

Said strain relieving function, for assisting insertion of strip 12 inside device 11, may be performed, in place of roller 40, by a removable blade element 49 as shown by the dotted line in FIG. 1.

We claim:

1. A device for changing reels of strip material on a production machine, said device comprising, in a first operating position, a spindle for supporting a runout reel off which a traction device unwinds and feeds a first strip to the production machine along a given path; means for supporting a standby reel in a second operating position; means for unwinding a second strip, identical to the first strip, off said standby reel and through a guide device located along said given path of said first strip and designed to feed the second strip on to the traction device when the first strip runs out; and a swing arm supporting means for gripping and supporting the standby reel; characterized by the fact that said means for unwinding the standby reel and said means for gripping and supporting the standby reel consist of a powered element fitted to said arm so as to rotate about an axis parallel to the axis of said supporting spindle, and having gripping means for gripping and rendering the standby reel integral with the powered element, and a locating spindle coaxial with the rotation axis of the powered element and so designed as to only cooperate with an input portion of the core of said standby reel; said swing arm being designed to transfer said standby reel from said second operating position on to said spindle supporting the runout reel, when said first strip runs out.

2. A device as claimed in claim 1, characterized by the fact that said swing arm is supported on a shaft having its axis parallel to that of said supporting spindle, and is movable alternatively between said second operating position, wherein said locating spindle is substantially coaxial with the rotation axis of the standby reel, and said first operating position, wherein said locating spindle is substantially coaxial with said spindle supporting the runout reel; said powered element and said supporting spindle of the runout reel being axially movable to and from said reels and on either side of the reel plane; said supporting spindle being selectively positionable in an extracted position, wherein it engages the core of the runout reel, and a withdrawn position, wherein it is detached from the core of the runout reel; said spindles being so designed as to simultaneously engage, on either side, the core of a given reel.

3. A device as claimed in claim 2, characterized by the fact that at least said supporting spindle is self-centering.

4. A device as claimed in claim 1, characterized by the fact that said powered element is a disk mounted idly on one end of said arm; said gripping means being defined by respective peripheral suction cups arranged in a ring on said disk and connected to a vacuum source; said arm also being fitted with an electric motor for driving said disk and which, when turned off, acts as a power brake.

5. A device as claimed in claim 1, characterized by the fact that said supporting means are defined by a saddle for supporting said standby reel on edge and also comprising a store for a number of standby reels; said store comprising a pair of rails substantially parallel to the rotation axis of said powered element and on which the standby reels are supported on edge, and means for loading the standby reels one at a time on to said supporting saddle.

6. A device as claimed in claim 5, characterized by the fact that said supporting saddle is defined by at least two rollers parallel to said rails and each fitted idly to a first end of a respective lever, the second end of each lever, opposite the first end, being mounted for rotation, parallel to the rotation axis of said rollers, on a respective powered pin; said device also comprising a third roller fitted to one end of a swing arm pivoting about an axis parallel to that of the rollers of said supporting saddle; said swing arm being designed to selectively position said third roller in an idle position, wherein it is clear of the standby reel, and an operating position, wherein it cooperates with and contacts the standby reel and is located substantially over the supporting saddle.

7. A device as claimed in claim 2, further comprising a locating arm, a first end of which presents a feel roller cooperating with and contacting said reels, and the second end of which rotates about a pivot so located, in relation to the shaft supporting the swing arm, as to enable said locating arm to maintain said roller permanently contacting the standby reel along the entire path described by the swing arm for transferring the standby reel from said second operating position on to said supporting spindle, and to maintain said roller contacting the runout reel on the opposite side in relation to said supporting means.

* * * * *

UNITED STATES PATENT AND TRADEMARK OFFICE

CERTIFICATE OF CORRECTION

PATENT NO. : 5,289,985

DATED : March 1, 1994

INVENTOR(S) : L. COCCHI et al.

It is certified that error appears in the above-indentified patent and that said Letters Patent is hereby corrected as shown below:

On the title page, item [73], "G.D." should be --G.D--.

At the cover sheet, under Assignee, section [73] of the printed patent, "G.D." should be ---G.D---.

Signed and Sealed this

Twenty-seventh Day of December, 1994

*Attest:*

*Attesting Officer*

BRUCE LEHMAN

*Commissioner of Patents and Trademarks*